US009067768B1

(12) United States Patent
Johnson et al.

(10) Patent No.: US 9,067,768 B1
(45) Date of Patent: Jun. 30, 2015

(54) CRANE RIGGING LIGHTING SYSTEM AND METHOD

(71) Applicant: Construction Innovations, Inc., Pine City, MN (US)

(72) Inventors: Todd Johnson, Wyoming, MN (US); Glen J. Harmon, Pine City, MN (US)

(73) Assignee: Construction Innovations, Inc., Pine City, MN (US)

( * ) Notice: Subject to any disclaimer, the term of this patent is extended or adjusted under 35 U.S.C. 154(b) by 275 days.

(21) Appl. No.: 13/796,786

(22) Filed: Mar. 12, 2013

Related U.S. Application Data

(60) Provisional application No. 61/737,734, filed on Dec. 14, 2012, provisional application No. 61/754,514, filed on Jan. 18, 2013.

(51) Int. Cl.

| | |
|---|---|
| ***H01K 7/00*** | (2006.01) |
| ***B66C 15/06*** | (2006.01) |
| ***F21V 33/00*** | (2006.01) |
| ***H05B 33/08*** | (2006.01) |

(52) U.S. Cl.
CPC ..... *B66C 15/065* (2013.01); *F21V 33/0076* (2013.01); *H05B 33/08* (2013.01)

(58) Field of Classification Search
CPC ..... B66C 1/40; B66C 13/46; B66C 15/06; B66C 15/065; B66C 23/90; B66C 23/905
See application file for complete search history.

(56) References Cited

U.S. PATENT DOCUMENTS

| | | | | |
|---|---|---|---|---|
| 3,641,551 | A | 2/1972 | Sterner et al. | |
| 4,281,342 | A * | 7/1981 | Ueda et al. | 348/94 |
| 5,019,798 | A | 5/1991 | Pherigo, Jr. | |
| 6,894,621 | B2 | 5/2005 | Shaw | |
| 7,656,459 | B2 * | 2/2010 | Catanzaro | 348/372 |

* cited by examiner

*Primary Examiner* — Jeffrey Zweizig
(74) *Attorney, Agent, or Firm* — Charles A. Lemaire; Jonathan M. Rixen; Lemaire Patent Law Firm, P.L.L.C.

(57) ABSTRACT

The present invention provides devices and methods for remotely illuminating the hook assembly and/or other load-end portions (e.g., a ball hook, block hook, crane spreader-bar and the like) of a crane rigging.

20 Claims, 6 Drawing Sheets

90
92
93
94
95
96
97
99
102
103
104
110
130
150
151
152
153
154
155
191
192
194

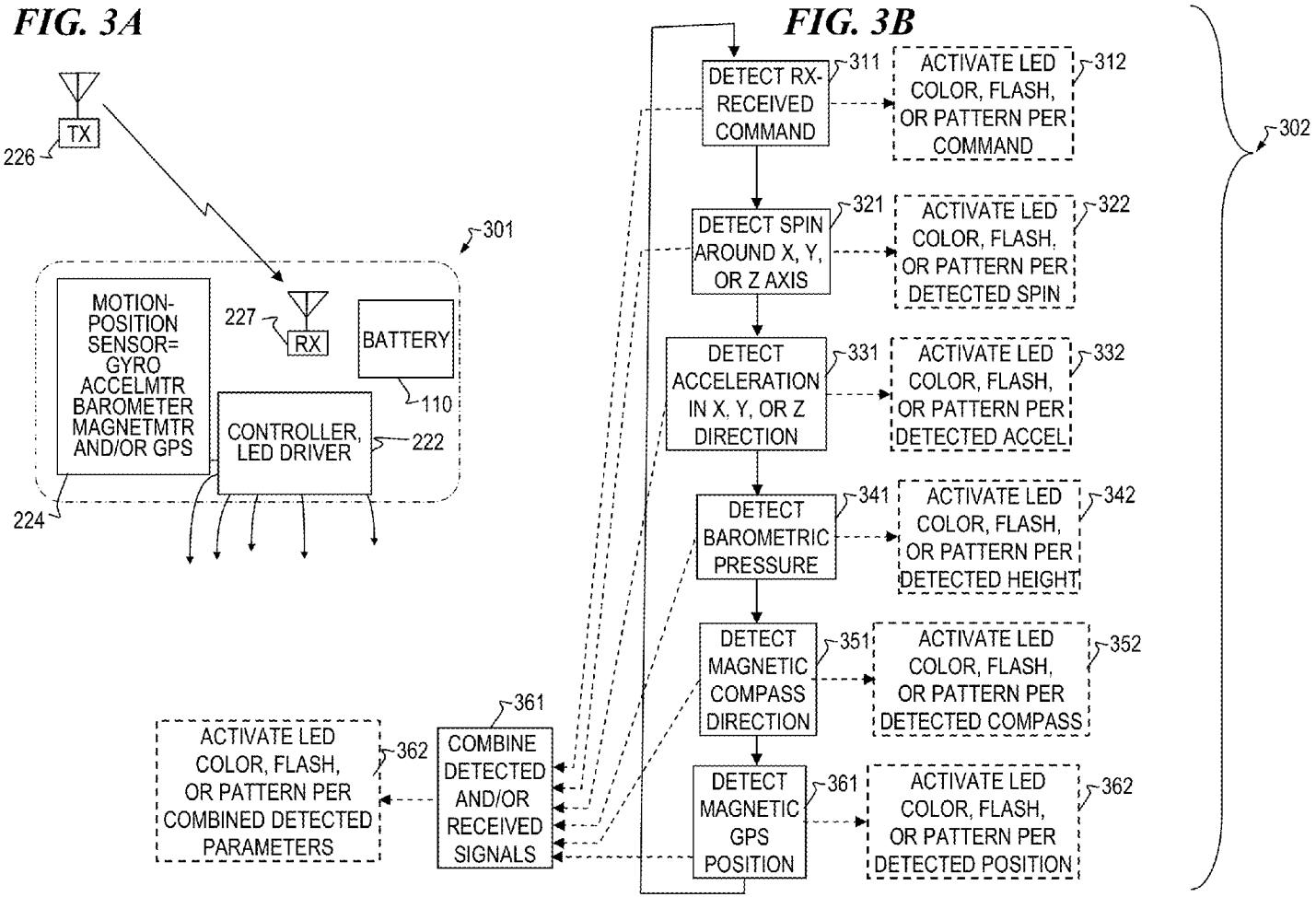
FIG. 3A
FIG. 3B
302
301
TX
226
MOTION-POSITION SENSOR= GYRO ACCELMTR BAROMETER MAGNETMTR AND/OR GPS
224
227
RX
BATTERY
110
CONTROLLER, LED DRIVER
222
DETECT RX-RECEIVED COMMAND
311
ACTIVATE LED COLOR, FLASH, OR PATTERN PER COMMAND
312
DETECT SPIN AROUND X, Y, OR Z AXIS
321
ACTIVATE LED COLOR, FLASH, OR PATTERN PER DETECTED SPIN
322
DETECT ACCELERATION IN X, Y, OR Z DIRECTION
331
ACTIVATE LED COLOR, FLASH, OR PATTERN PER DETECTED ACCEL
332
DETECT BAROMETRIC PRESSURE
341
ACTIVATE LED COLOR, FLASH, OR PATTERN PER DETECTED HEIGHT
342
DETECT MAGNETIC COMPASS DIRECTION
351
ACTIVATE LED COLOR, FLASH, OR PATTERN PER DETECTED COMPASS
352
DETECT MAGNETIC GPS POSITION
361
ACTIVATE LED COLOR, FLASH, OR PATTERN PER DETECTED POSITION
362
COMBINE DETECTED AND/OR RECEIVED SIGNALS
361
ACTIVATE LED COLOR, FLASH, OR PATTERN PER COMBINED DETECTED PARAMETERS
362

CRANE RIGGING LIGHTING SYSTEM AND METHOD

CROSS-REFERENCE TO RELATED APPLICATIONS

This application claims priority benefit under 35 U.S.C. §119(e) of U.S. Provisional Patent Application No. 61/737,734 filed Dec. 14, 2012 by Todd Johnson et al., titled "CRANE RIGGING LIGHTING SYSTEM AND METHOD," and U.S. Provisional Application No. 61/754,514 filed Jan. 18, 2013 by Todd Johnson et al., titled "CRANE RIGGING LIGHTING SYSTEM AND METHOD," each of which is incorporated herein by reference in its entirety.

FIELD OF THE INVENTION

The present invention relates to crane-rigging lighting systems and methods, and more particularly to devices and methods for remotely illuminating the hook assembly and/or other load-end portions (e.g., a ball hook, block hook, crane spreader-bar and the like) of a crane rigging.

BACKGROUND OF THE INVENTION

Cranes used for large industrial projects (e.g., cranes used at refineries) often have booms that are hundreds of feet in length, and the overall crane may weigh hundreds of tons. Multiple operators are often teamed together to operate large cranes in order to more safely perform the necessary lifting tasks. An operator of large crane may be over 200 feet away from the hook being used to lift and move the target load, which makes it hard to observe the precise location and orientation of the hook and other load-end structures used to connect to and support the target load. When large cranes are operated in low levels of light, the ability to monitor the position of the load end of the crane is made even more difficult and therefore adds to the already complex task of safely operating the crane. Conventional techniques for illuminating the load end of a large crane include affixing flashlights to the hook or surrounding load-end areas using everyday items like tape.

U.S. Pat. No. 3,641,551 to Russell L. Sterner et al. (hereinafter, "Sterner et al."), titled "SAFE LOAD CONTROL SYSTEM FOR TELESCOPIC CRANE BOOMS" issued Feb. 8, 1972, and is incorporated herein by reference. Sterner et al. describe an overload prevention and indicator system for telescopic boom cranes of the stationary and/or mobile types in which the boom is pivotally raised and lowered in vertical planes by hydraulic lift motor means, the system including first electrical circuit means responsive to complete a selected on of a plurality of circuits corresponding to the length of the boom, the plurality of circuits being respectively connected in series to a corresponding plurality of second electrical circuit means, each representative of a predetermined increment of boom length, responsive to angular position of the telescopic boom in the vertical plane. The plurality of angular position outputs of each second electrical circuit means are connected according to predetermined crane overload information to a plurality of third circuit means representative of pressure range increments, and a pressure switch responsive to fluid pressure in the lift motor means, which is indicative of boom load, is connected to successively operate said third circuit means as the fluid pressure in said lift motor means increases and actuate an indicator and render inoperative selected operations of the crane when the crane approaches an overload or tipping condition at the particular length, angle and load condition at which it is operating at any instant.

There is a need for an improved system and method for remotely illuminating the load end of a crane rigging such that the location and orientation of the load-end structures of the crane rigging can be more effectively observed.

SUMMARY OF THE INVENTION

In some embodiments, the present invention provides devices and methods to light the load-end rigging on a crane for assisting the operator in providing safe operation. In some embodiments, the devices include a fabric substrate onto which are affixed a plurality of water-proof LED assemblies and a self-contained power supply (such as a battery), controller, and LED driver. In some embodiments, the controller receives a plurality of parameters and based on the parameters drives different LEDs to provide different colors, flash sequences, spatial patterns, constant-on lighting, combinations or subcombinations of the preceding, or the like.

BRIEF DESCRIPTION OF THE FIGURES

FIG. 1A is a schematic diagram of an exemplary crane system 90 with which one or more embodiments of present invention may be used for enhanced safety, usability, and functionality.

FIG. 1B a schematic perspective-side-view diagram of a crane-rigging lighting system 102, according to some embodiments of the present invention.

FIG. 1C-1 is a schematic front-view diagram of a crane-rigging lighting system 103, according to some embodiments of the present invention.

FIG. 1C-2 is a schematic side-view diagram of crane-rigging lighting system 103, according to some embodiments of the present invention.

FIG. 1D is a schematic perspective-side-view diagram of a crane-rigging lighting system 104, according to some embodiments of the present invention.

FIG. 3A is a schematic circuit block diagram of a crane-rigging lighting system 301, according to some embodiments of the present invention.

FIG. 3B is a flowchart of a crane-rigging lighting system and method 302, according to some embodiments of the present invention.

DETAILED DESCRIPTION OF THE INVENTION

Although the following detailed description contains many specifics for the purpose of illustration, a person of ordinary skill in the art will appreciate that many variations and alterations to the following details are within the scope of the invention. Accordingly, the following preferred embodiments of the invention are set forth without any loss of generality to, and without imposing limitations upon the claimed invention. Further, in the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

Figures 1, 1A, 1B, 1C, 1D, 2:
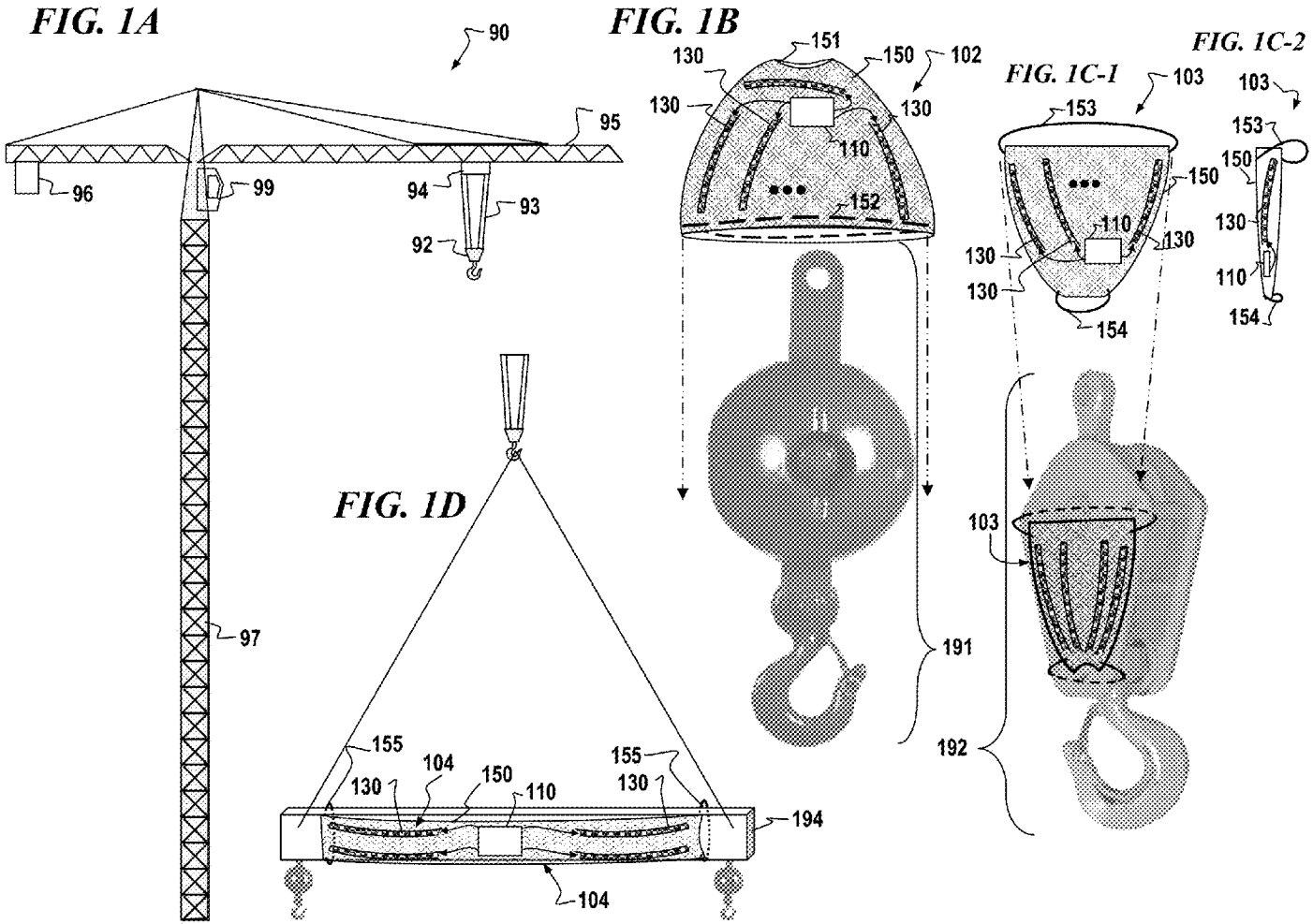

FIG. 1A is a schematic diagram of a crane system 90. In some embodiments, system 90 includes a vertical tower mast 97, a counter-jib weight 96, an operator cab 99, and a horizontal jib boom 95. In some embodiments, crane system 90 further includes a hook assembly 92, a steel-cable rope 93, and a trolley 94. Large ones of such crane systems 90 may be several hundred feet high, and are often used in refinery environments after dark. It is essential that the crane operator located in cab 99 be able to see the position and/or orientation of hook assembly 92. Accordingly, the present invention provides a lighting system and method for easily attaching battery-operated LED lighting to the load-end structures such as hook assembly 92. FIG. 1B, FIG. 1C (1C-1 and 1C-2), and FIG. 1D show three exemplary hook assemblies (where ball hook 191, block hook 192, or spreader bar hook assembly 194 each represent different embodiments of hook assembly 92 of FIG. 1A) and specifically adapted lighting systems for those hook assemblies.

FIG. 1B is a schematic diagram of a crane-rigging lighting system 102. In some embodiments, system 102 is configured to be used with a crane-overhaul-ball structure 191 (usually called a ball hook 192). In some embodiments, lighting system 102 includes a poncho-shaped fabric 150 that is configured to be fit onto structure 191. In some embodiments, poncho-shaped fabric 150 has a flat torus shape (e.g., a circular shape having a central circular hole that fits around the top bar structure) that includes a first (smaller) inner diameter surrounding the central hole and a second (larger) outer diameter at the outer circumference. Other embodiments are sewn in a more conical or spherical shape. Still others have a plurality of fingers (similar to a daisy—see FIG. 2I described below) and a bottom draw-string cord or elastic (bungee-cord-like) fastening structure to tie the fabric around the ball. In some embodiments, poncho 150 is configured to be placed over structure 191 (as shown in FIG. 1A) and the inner diameter of poncho 150 forms a hole 151 large enough such that the rigging from a crane can connect to structure 191 while poncho 150 is in position on structure 191. In some embodiments, poncho 150 includes a tightening structure 152 that is configured to allow poncho 150 to be pulled over structure 191 and tightened in place such that poncho 150 stays connected to structure 191 during use of structure 191. In some embodiments, structure 152 is an elastic material. In some embodiments, structure 152 is a rope-like material that can be synched tight once poncho 150 is in place around structure 191. In some embodiments, structure 152 is any other suitable structure. In some embodiments (as shown in FIG. 1B), structure 152 is located along the perimeter of the outer diameter of poncho 150. In some embodiments, poncho 150 is held to structure 191 in any other suitable manner. In some embodiments, system 102 includes a plurality of light emitters 130 that are powered by a battery 110 (in some embodiments, battery 110 is provided by an 8-cell AA-size battery holder). In some embodiments, the plurality of light emitters 130 includes a plurality of light-emitting diodes (LEDs) 130. In some embodiments, the plurality of light emitters 130 are certified as "intrinsically safe" by the Factory Mutual Research Corporation. In some embodiments, the plurality of light emitters 130 includes a plurality of individual light strips 130 such that each individual light strip 130 is placed in its own pocket on the poncho-shaped fabric 150. In some embodiments, each light strip 130 includes a plurality of light-emitting diodes (LEDs), and, in some embodiments, the LED strips 130 are provided embedded in a clear flexible polymer encapsulant with a plurality of electrical wires sufficient to provide the control of as many different combinations of LEDS as are designed to be separately controlled (e.g., some embodiments use 2 wires where simple on-off control is needed, while other embodiments use 4-wires to control a strip of red, green and blue LEDs that are separately controlled, and still other embodiments use many wires to control strips of single-color or red, green and blue LEDs that are sequentially activated to show a direction of motion or spin to the operator).

FIG. 1C-1 is a schematic front-view diagram of a crane-rigging lighting system 103. In some embodiments, trapezoid-shaped fabric 150 of system 103 has a trapezoid that includes a first (smaller) bottom edge and a second (larger) top edge, and two angled side edges (or, in other embodiments, other suitable polygonal or curved shape). In some embodiments, system 103 is configured to be used with a crane-block structure 192. In some such embodiments, trapezoid-shaped fabric 150 of system 103 includes a first tightening structure 153 (e.g., an elastic bungee-type material, or a cord that can be manually tightened) located along the top edge of fabric 150 and a second tightening structure 154 (e.g., an elastic bungee-type material, or a cord that can be manually tightened) located along the bottom edge of trapezoid-shaped fabric 150 such that trapezoid-shaped fabric 150 can be placed over and secured to one face of block-hook structure 192. Some embodiments use a second crane-rigging lighting system 103 for the opposite face of block-hook structure 192.

FIG. 1C-2 is a schematic side-view diagram of crane-rigging lighting system 103.

FIG. 1D is a schematic diagram of a crane-rigging lighting system 104. In some embodiments, system 104 includes a substantially rectangular fabric 150 that is configured to be used with a crane spreader bar 194. In some embodiments, rectangular fabric 150 includes a first tightening structure 155 to be attached around the bar near a first end of spreader bar 194 and a second tightening structure 155 to be attached around the second end (opposite the first end) of spreader bar 194.

Figure 2B:
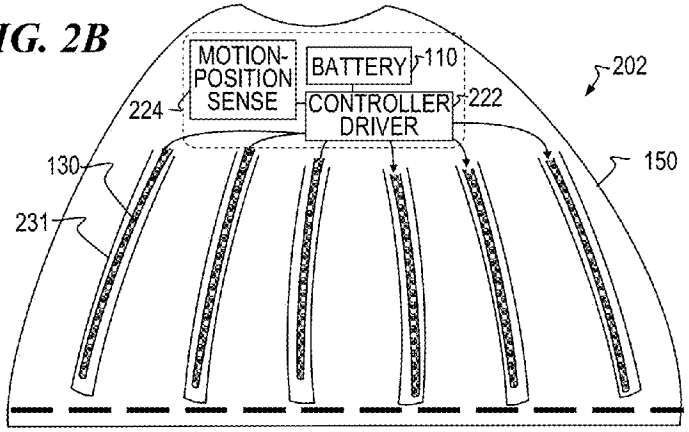
FIG. 2B is a schematic perspective-side-view diagram of a crane-rigging lighting system 202, according to some embodiments of the present invention.
Figure 2A:
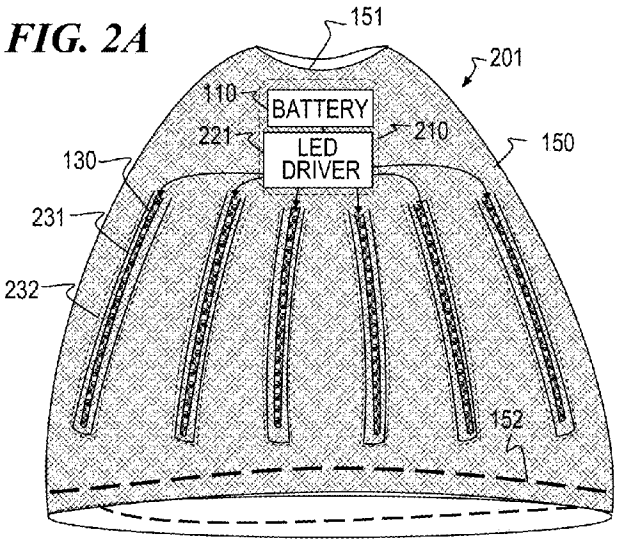
FIG. 2A is a schematic perspective-side-view diagram of a crane-rigging lighting system 201, according to some embodiments of the present invention.

FIG. 2A is a schematic diagram of a crane-rigging lighting system 201. In some embodiments, crane-rigging lighting system 201 includes a fabric poncho 150. In some embodiments, poncho-shaped fabric 150 is configured to fit (i.e., to be attached) securely to a ball hook. In some embodiments, poncho-shaped fabric 150 includes a canvas fabric (in some such embodiments, the canvas fabric is a fire-retardant-rated (FR-rated) canvas fabric). In some embodiments, poncho-shaped fabric 150 includes any other suitable material, such as other cloth, non-woven fabric, polymer film, or the like. In some embodiments, poncho 150 has a torus shape (i.e., a doughnut shape) that includes a first (smaller) inner diameter and a second (larger) outer diameter. In some embodiments, poncho-shaped fabric 150 is placed over an overhaul ball or crane block and the inner diameter hole of poncho-shaped fabric 150 is large enough such that the rigging from a crane can connect to the overhaul ball or crane block while poncho-shaped fabric 150 is in position on the overhaul ball or crane block. In some embodiments, poncho 150 includes an elastic material or manually tightenable cord that is configured to allow poncho 150 to stretch over the overhaul ball or crane block and hold poncho 150 securely in place on the overhaul ball or crane block.

In some embodiments, poncho 150 includes a plurality of pockets 231 that are each configured to hold the plurality of light emitters 130 (e.g., an encapsulated LED strip or the like). In some embodiments, each pocket 231 is a clear tubular structure (see FIG. 2E) sewn onto poncho 150 using stitches 232. In some embodiments, the plurality of light emitters 130 are driven by an electrical circuit 220 (e.g., a LED driver), which is in turn powered by a battery 110. In some embodiments, battery 110 and electrical circuit 220 are affixed to poncho 150. In some such embodiments, battery 110 and electrical circuit 220 are sewn into poncho 150. In some such embodiments, the LEDs are simply turned on and stay on constantly during operation.

FIG. 2B is a schematic diagram of a crane-rigging lighting system 202. In some embodiments, system 201 includes a motion-position sensor 224 (e.g., in some embodiments, a solid-state electronic barometer for determining height, solid-state electronic 3-axis gyroscope for determining spin, solid-state electronic 3-axis accelerometer for determining acceleration, solid-state electronic 3-axis magnetometer for determining geographic direction, and/or a load sensor for determining whether there is a certain weight being held) and a controller driver 222. In some embodiments, sensor 224 is configured to sense the orientation and/or altitude of system 202 and send sense signals to the controller driver 222 based on the sensed conditions (in some embodiments, sensor 224 includes an electronic accelerometer, gyroscope, magnetometer, barometer, and/or global-positioning sensor (GPS)). In some such embodiments, controller driver 222 is configured to automatically control the output (e.g., light color, light flashing pattern, solid-on state, and the like) from the plurality of light emitters 130 based on the received sense signals from sensor 224. For example, in some embodiments, system 202 is used with a crane overhaul ball, and when sensor 224 senses that the overhaul ball is moving upward, controller driver 222 automatically controls the plurality of LEDs 230 to emit a flashing red light. In some embodiments, sensor 224 is affixed to poncho 150 (in some embodiments, sensor 224 is sewn onto poncho 150, or placed in a pocket on poncho 150). In some embodiments, sensor 224 includes an electronic controller such are commonly availably to control model quadcopters (such as the Copter Control or Revolution microprocessors available from www.openpilot.org, but which is reprogrammed for the specific sensing functions needed by the crane operator to determine the position and orientation of the load-end rigging on his or her crane).

Figure 2C:
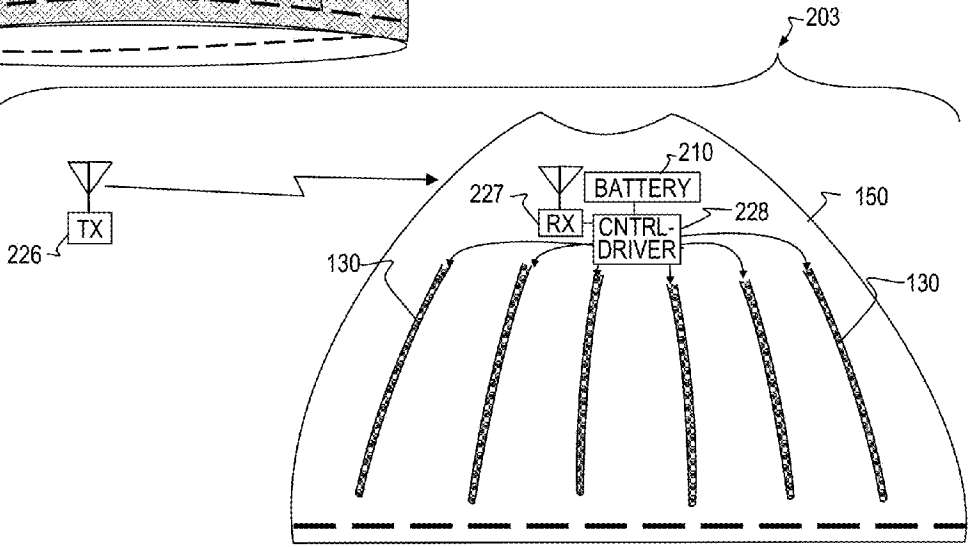
FIG. 2C is a schematic perspective-side-view diagram of a crane-rigging lighting system 203, according to some embodiments of the present invention.

FIG. 2C is a schematic diagram of a crane-rigging lighting system 203. In some embodiments, system 203 includes a transmitter 226 located remotely from poncho 150 (e.g., a transmitter such as commonly used to control radio-controlled model aircraft) and a receiver operatively coupled to a controller driver 228 that is affixed to poncho 150. In some embodiments, system 203 allows an operator to remotely control the plurality of light emitters 130 by sending control signals from transmitter 226 that are received at receiver 227 and then passed to controller driver 228. Thus, the remote transmitter sends commands that are used by controller 228 to provide different color, temporal (time) patterns, and/or spatial patterns in the emitted light.

Figure 2E:
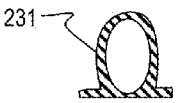
FIG. 2E is a cross-section diagram of a holder 231 for holding strip-type LED assemblies 130, according to some embodiments of the present invention.
Figure 2F:
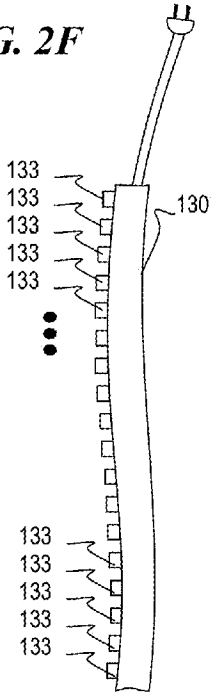
FIG. 2F is a side-view diagram of a strip-type LED assembly 130, according to some embodiments of the present invention.
Figure 2D:
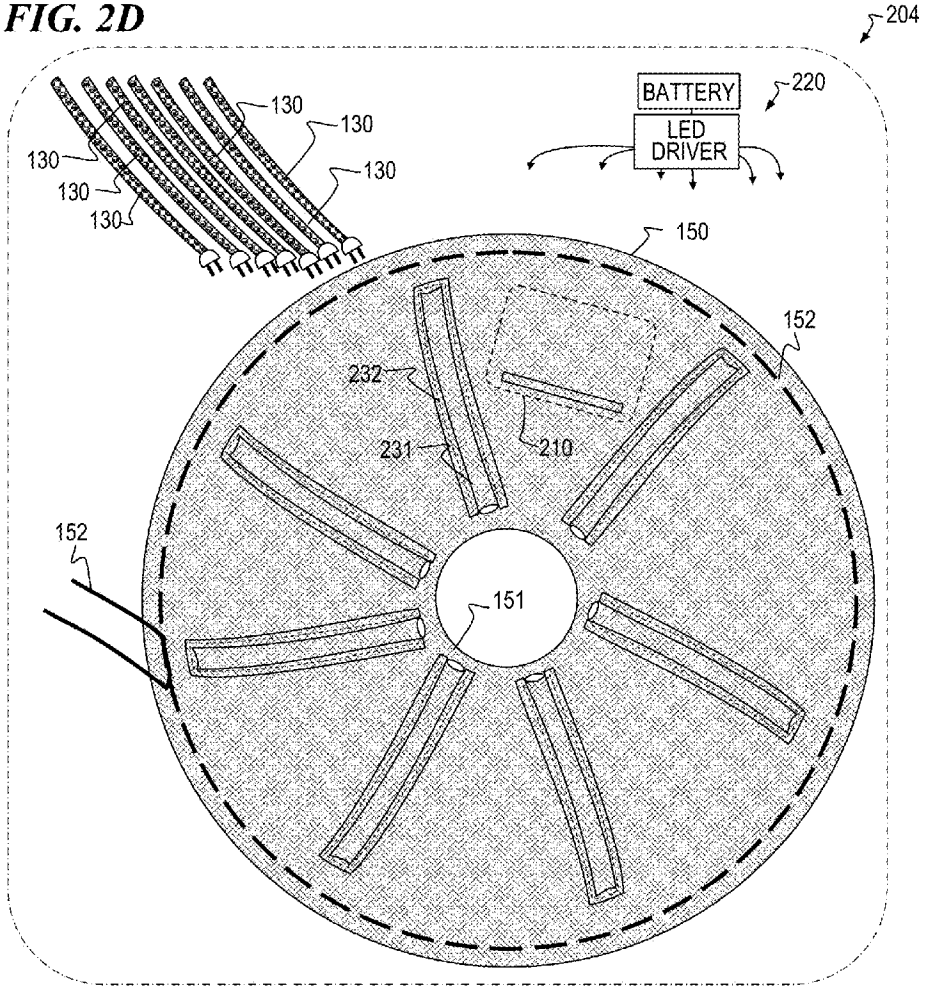
FIG. 2D is a schematic plan-view diagram of a crane-rigging lighting system kit 204, according to some embodiments of the present invention.

FIG. 2D is a schematic plan-view diagram of a crane-rigging lighting system kit 204, according to some embodiments of the present invention. In some embodiments, fabric 150 has a circular outer circumference, an elastic or draw cord 152, and an inner-diameter hole 151, and a plurality of pockets 231 that are sewn with stitching 232 to the fabric 150. A plurality of LED strips 130 with electrical plugs are provided and are placed in the provided pockets 231. A controller and power supply 220 (any of those shown in FIG. 2A, 2B, 2C, or 3A or combinations thereof) are provided and fit into the slit to be completely inside pocket 210.

FIG. 2E is a cross-section diagram of a holder 231 for holding strip-type LED assemblies 130, according to some embodiments of the present invention. The side flaps provide a surface that can be sewn to fabric 150, and the oval-shaped opening helps align the LEDs to the desired illumination direction.

FIG. 2F is a side-view diagram of a strip-type LED assembly 130, according to some embodiments of the present invention. In some embodiments, the plurality of LED devices 133 are embedded in a clear flexible polymer, and have electrical signal cabling that attaches to controller 220.

Figure 2G:
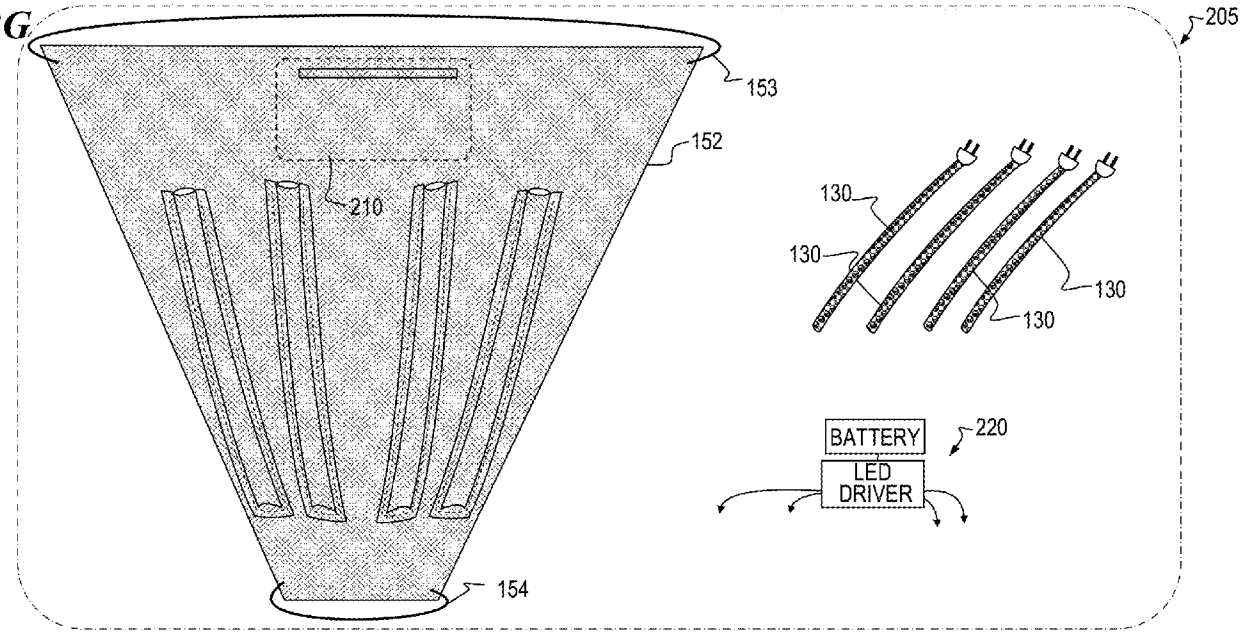
FIG. 2G is a schematic plan-view diagram of a crane-rigging lighting system kit 205, according to some embodiments of the present invention.

FIG. 2G is a schematic plan-view diagram of a crane-rigging lighting system kit 205, according to some embodiments of the present invention. In some embodiments, trapezoid-shaped fabric 152 of system kit 205 has a trapezoid shape that includes a first (smaller) bottom edge and a second (larger) top edge, and two angled side edges (or, in other embodiments, other suitable polygonal or curved shape). Other features are as described above in the description of FIGS. 1C-1, 1C-2, and 2D.

Figure 2H:
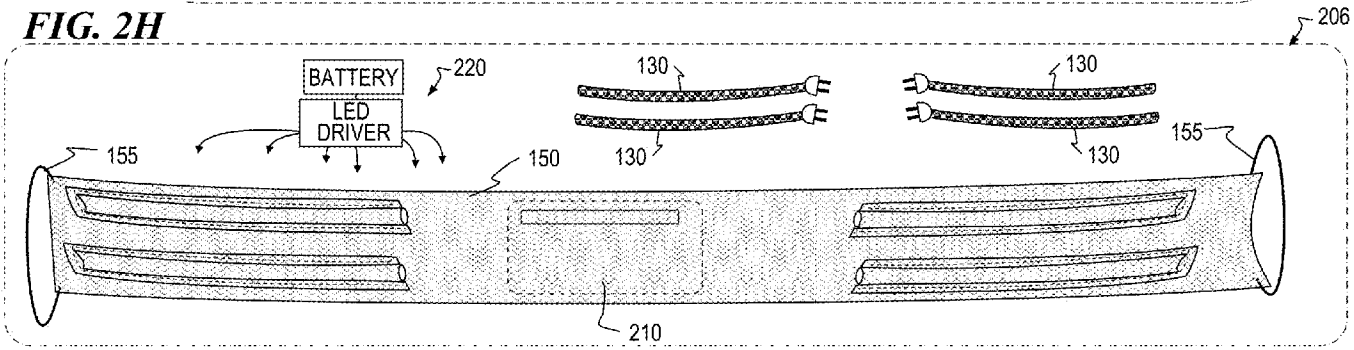
FIG. 2H is a schematic plan-view diagram of a crane-rigging lighting system kit 206, according to some embodiments of the present invention.

FIG. 2H is a schematic plan-view diagram of a crane-rigging lighting system kit 206, according to some embodiments of the present invention. In some embodiments, system 104 includes a substantially rectangular fabric 150 that is configured to be used with a crane spreader bar 194. Other features are as described above in the description of FIGS. 1D and 2D.

Figure 2I:
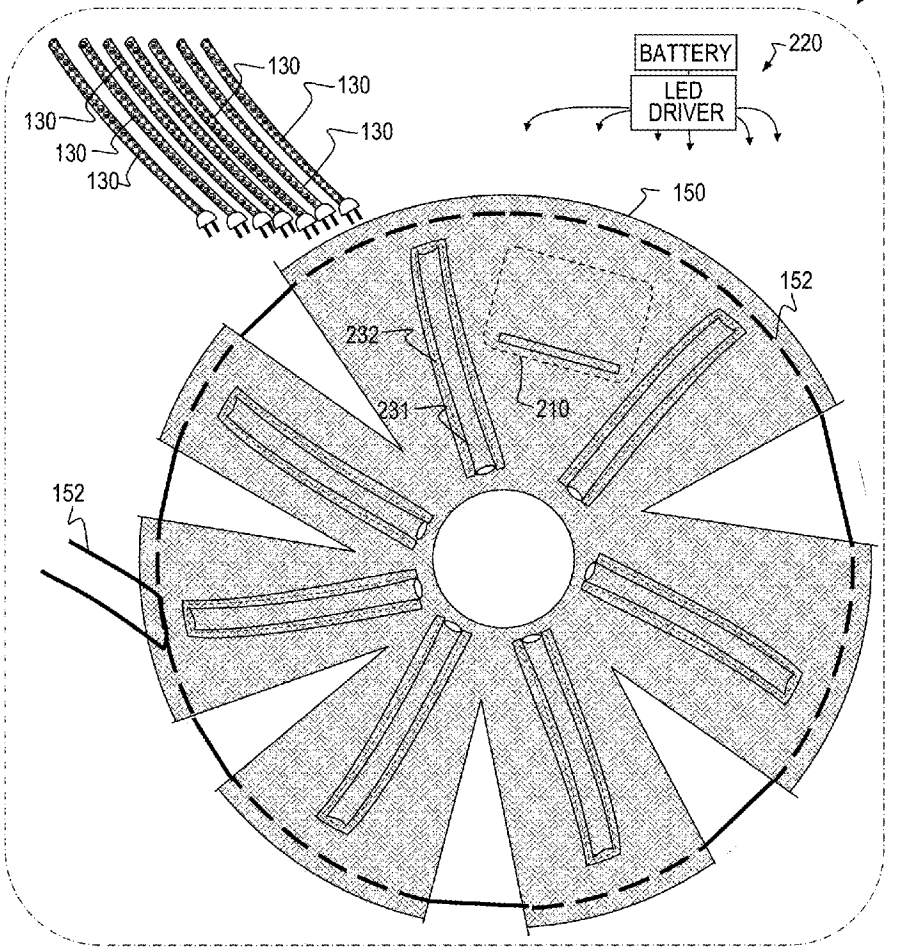
FIG. 2I is a schematic plan-view diagram of a crane-rigging lighting system kit 207, according to some embodiments of the present invention.

FIG. 2I is a schematic plan-view diagram of a crane-rigging lighting system kit 207, according to some embodiments of the present invention. In some embodiments, crane-rigging lighting system kit 207 is just like kit 204 of FIG. 2D, except that slits are cut to form a daisy shape that fits more snugly around a ball hook.

FIG. 3A is a schematic circuit block diagram of a crane-rigging lighting system 301, according to some embodiments of the present invention. System 301 combines the receiver function and motion-positioning sensing as described above all in a single system that is programmed according to one or more of the functions set forth in FIG. 3B FIG. 3B is a flowchart of a crane-rigging lighting system and method 302, according to some embodiments of the present invention. The figure is self explanatory.

It is specifically contemplated that the present invention includes embodiments having combinations and subcombinations of the various embodiments and features that are individually described herein (i.e., rather than listing every combinatorial of the elements, this specification includes descriptions of representative embodiments and contemplates embodiments that include some of the features from one embodiment combined with some of the features of another embodiment). Further, some embodiments include fewer than all the components described as part of any one of the embodiments described herein.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. An apparatus comprising:

a poncho configured to be attached to a hook-structure on a load end of a crane rigging;

a plurality of light emitters attached to the poncho, wherein the plurality of light emitters are configured to emit a plurality of light signals; and a controller circuit attached to the poncho and operatively coupled to the plurality of light emitters, wherein the controller circuit is configured to control the emission of the plurality of light signals.

2. The apparatus of claim 1, wherein the poncho includes a canvas fabric.

3. The apparatus of claim 1, wherein the poncho includes a fire retardant canvas fabric.

4. The apparatus of claim 1, wherein the poncho includes an elastic material.

5. The apparatus of claim 1, wherein the plurality of light emitters includes a plurality of light-emitting diodes (LEDs).

6. The apparatus of claim 1, wherein the plurality of light emitters are sewn onto the poncho.

7. The apparatus of claim 1, wherein the plurality of light emitters are attached to the poncho by placing the plurality of light emitters in pockets located on the poncho.

8. The apparatus of claim 1, further comprising a power supply attached to the poncho and configured to provide power to the controller circuit and the plurality of light emitters.

9. The apparatus of claim 1, further comprising a motion-position sensor attached to the poncho and operatively coupled to the controller driver.

10. The apparatus of claim 1, further comprising:

a transmitter located at a first distance away from the poncho, wherein the transmitter is configured to transmit a plurality of control signals; and a receiver attached to the poncho and operatively coupled to the controller circuit, wherein the receiver is configured to receive the plurality of control signals and transfer them to the controller circuit in order to remotely control the plurality of light emitters.

11. The apparatus of claim 1, wherein the poncho is configured to be attached to an overhaul ball hook-structure.

12. The apparatus of claim 1, wherein the poncho is configured to be attached to a crane block hook-structure.

13. The apparatus of claim 1, wherein the poncho is configured to be attached to a spreader bar hook-structure.

14. A method for lighting and controlling the lighting of crane rigging, the method comprising:

affixing a plurality of LED units to a fabric substrate, affixing the substrate to a crane hook, controlling the LED lighting color, spatial patterns, and/or temporally patterns to show the position, orientation, and/or movement of the crane hook.

15. The method of claim 14, wherein the affixing of the plurality of LED units includes sewing the plurality of LED units to the fabric substrate.

16. The method of claim 14, wherein the affixing of the plurality of LED units includes placing the plurality of LED units in pockets located on the fabric substrate.

17. The method of claim 14, wherein the fabric substrate includes a rope-like material, and wherein the affixing of the fabric substrate includes synching the rope-like material once the fabric substrate is placed around the crane hook.

18. The method of claim 14, further comprising:

attaching a power supply to the fabric substrate; and supplying power to the plurality of LED units via the power supply.

19. The method of claim 14, further comprising:

sensing a position and an orientation of the crane hook;

generating a sense signal corresponding to the sensed position and orientation, wherein the controlling is based on the sense signal.

20. The method of claim 14, further comprising:

transmitting a plurality of control signals from a first distance away from the fabric substrate;

providing a receiver operatively coupled to the fabric substrate; and receiving the plurality of control signals at the receiver, wherein the controlling is based on the received plurality of control signals.

* * * * *